US008029700B2

(12) United States Patent
Wei et al.

(10) Patent No.: US 8,029,700 B2
(45) Date of Patent: Oct. 4, 2011

(54) COMPOUND OF SILVER NANOWIRE WITH POLYMER AND COMPOUND OF METAL NANOSTRUCTURE WITH POLYMER

(75) Inventors: Ming-Hsiung Wei, Zhongli (TW); Kuo-Chu Hwang, Houpi Hsian (TW); Chieh-Lin Kuo, Tucheng (TW); Kai-Yia Chang, Taipei (TW)

(73) Assignee: Chung-Shan Institute of Science and Technology Armaments Bureau, Ministry of National Defense, Taoyuan County (TW)

( * ) Notice: Subject to any disclaimer, the term of this patent is extended or adjusted under 35 U.S.C. 154(b) by 268 days.

(21) Appl. No.: 12/433,289

(22) Filed: Apr. 30, 2009

(65) Prior Publication Data

US 2010/0276648 A1 Nov. 4, 2010

(51) Int. Cl.
*H01B 1/00* (2006.01)
*H01B 1/22* (2006.01)

(52) U.S. Cl. ..... 252/512; 252/514

(58) Field of Classification Search ..... 252/500, 252/514

See application file for complete search history.

(56) References Cited

U.S. PATENT DOCUMENTS

| | | | | |
|---|---|---|---|---|
| 7,348,365 | B2 * | 3/2008 | Lee et al. | 516/78 |
| 2005/0013842 | A1 * | 1/2005 | Qiu et al. | 424/423 |
| 2005/0153078 | A1 * | 7/2005 | Bentley et al. | 427/443.1 |
| 2006/0068025 | A1 * | 3/2006 | Chang et al. | 424/618 |
| 2006/0286684 | A1 * | 12/2006 | Brennan et al. | 436/525 |
| 2007/0190323 | A1 * | 8/2007 | Lee et al. | 428/402 |
| 2008/0166670 | A1 * | 7/2008 | Park et al. | 430/346 |
| 2008/0169122 | A1 * | 7/2008 | Shiraishi et al. | 174/257 |
| 2008/0206488 | A1 * | 8/2008 | Chung et al. | 427/596 |
| 2008/0241262 | A1 * | 10/2008 | Lee et al. | 424/490 |
| 2008/0283799 | A1 * | 11/2008 | Alden et al. | 252/500 |
| 2009/0189124 | A1 * | 7/2009 | Guiheen et al. | 252/500 |
| 2010/0140564 | A1 * | 6/2010 | Overbreek et al. | 252/514 |

FOREIGN PATENT DOCUMENTS

| | | | |
|---|---|---|---|
| WO | WO 2006095611 | A1 * | 9/2006 |
| WO | WO 2007102734 | A1 * | 9/2007 |

* cited by examiner

*Primary Examiner* — Mark Kopec
*Assistant Examiner* — Jaison Thomas

(57) ABSTRACT

The invention provides a compound of silver nanowire with polymer. The compound comprises a resin, a dispersant, and a plurality of silver nanowires. The dispersant is capable of copolymerizing with the resin. The dispersant has a plurality of functional groups capable of connecting with the silver nanowires respectively. Therefore, the silver nanowires could disperse in the resin by means of the functional groups of the dispersant.

20 Claims, 3 Drawing Sheets

COMPOUND OF SILVER NANOWIRE WITH POLYMER AND COMPOUND OF METAL NANOSTRUCTURE WITH POLYMER

BACKGROUND OF THE INVENTION

1. Field of the Invention

The present invention relates generally to a compound of silver nanowire with polymer, and more particularly, the present invention relates to a compound which silver metal nanostructures dispersing therein and capable of restraining the metal nanostructures from drifting.

2. Description of the Prior Art

A conductive metallic colloid is formed by adding metallic particles in a resin (e.g. epoxy resin). On the market, silver particles are commonly doped in a resin to from a conductive silver colloid. Because the conductive silver colloid is colloidal, it could be printed on various kinds of electronic products by means of screen-printing so that it is broadly used in applications. For example, the conductive silver colloid could be used to manufacture a specific circuit, a film switch, or connect two conducting circuits.

The silver particles used for doping on the market mentioned above are generally micro-sized. However, if nano-sized silver particles could be doped in a resin, the resistivity of the conductive silver colloid could be further decreased, and the quality and the yield of the film circuit screen-printed by the conductive silver colloid could be improved. Moreover, the conductive silver colloid doped with silver nanoparticles may not required high-temperature thermal treatment, so that it might be favorable for a plastic substrate which is incapable of tolerating high-temperature thermal treatment.

On the other hand, different nano-types of silver doping (e.g. silver nanoparticles or silver nanowires) could be used for adjusting the characteristics of the conductive silver colloid. For example, if nanowires are doped in a resin, because the conducting path length of electrons is lengthened and the hopping distance between the conducting islands is shortened, the electronic circuit manufactured by the conductive silver colloid will increase its conductivity.

In the prior art, there are various kinds of methods for manufacturing various types of nano-sized silver. Those methods are such as wet chemical reduction method, mechanical polishing process, thermal cracking the precursor with silver, and high energy plasma pyrolysis, etc. However, though the methods for manufacturing silver nanoparticles or silver nanowires are developed in the prior art, there are still many problems in manufacturing a conductive silver colloid doped with those nano-sized silver. For example, nano-type silver should be well dispersed in a resin to make sure the good yield of the conductive silver colloid. Therefore, how to well disperse the nano-sized silver in a resin is the key point for the researchers.

Furthermore, in the application of film switch, the conductive silver colloid still has the problem of silver drifting (if other kinds of metal nanostructure is doped, the metal nanostructure could happen to drift). The phenomenon of silver drifting is that when a bias is added to the film switch formed by the conductive silver colloid under a wet condition, the silver particle in the film switch would drift according to the electric field to form a larger particle or a dendritic structure in the film, so as to affect the electronic device to induce an extraordinary situation and even damage the electronic devices.

In the prior art, in order to avoid the effect of drifting silvers, a layer of carbon colloid is disposed on the film switch to isolate the mist so as to avoid the silver particles in the film being oxidized or drifted. However, adding the carbon colloid layer would increase the cost of the film switch and complicate the manufacture. On the other hand, the thickness of the carbon colloid layer needs precisely controlling to avoid the thick thickness resulting in the carbon colloid layer peeling off and further affect the electronic device itself.

SUMMARY OF THE INVENTION

Accordingly, the main aspect of the present invention is to provide a compound of metal nanostructure with polymer to solve the problems mentioned above.

According to an embodiment, the compound of metal nanostructure with polymer of the invention comprises a colloid, a dispersant, and metal nanostructures. Wherein the dispersant monomer of the dispersant has at least a functional group, and the dispersant copolymerizes with the colloid to form a colloidal polymer. Furthermore, the metal nanostructures are doped in the colloidal polymer formed by the colloid and the dispersant.

In the embodiment, the functional groups of the dispersant monomer connect with the metal nanostructures, and the dispersant copolymerizes with the colloid so as to make the metal nanostructures disperse in the colloid by means of the functional groups of the dispersant monomer. Similarly, owing to the copolymerization of the dispersant and the colloid, the metal nanostructures connected to the functional groups of the dispersant monomer could be restrained from drifting by means of the copolymerization force.

Another aspect of the present invention is to provide a compound of silver nanowire with polymer which is capable of restraining the silver drifting phenomenon and well dispersing silver nanowires in a resin.

According to an embodiment, the compound of silver nanowire with polymer of the invention comprises a resin, a dispersant, and silver nanowires. Wherein the dispersant has at least a functional group and copolymerizes with the resin to form a colloidal polymer. Furthermore, the silver nanowires are doped in the colloidal polymer formed by the resin and the dispersant.

In the embodiment, the functional groups of the dispersant connect with the silver nanowires, and the dispersant copolymerizes with the resin so as to make the silver nanowires disperse in the resin by means of the functional groups of the dispersant. Similarly, owing to the copolymerization of the dispersant and the resin, the silver nanowires connected to the functional groups of the dispersant could be restrained from drifting by means of the copolymerization force.

Moreover, with the same amount of silver content, the compound of silver nanowire with polymer of the present invention has higher conductivity than the conductive silver colloid doped with silver nanoparticles. On the other hand, under the condition of lower resistivity (high conductivity), the doped content of silver nanowires in the compound could be lower that that of silver nanoparticles.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

The present invention provides a compound of silver nanowire with polymer, which silver nanowires are doped in a colloid. The silver nanowires could be well dispersed in the colloid by means of a dispersant to form the compound.

According to an embodiment, the compound of silver nanowire with polymer of the invention comprises a resin, a dispersant, and silver nanowires. The dispersant copolymerizes with the resin to form a colloidal polymer. Each of the dispersant monomers of the dispersant has functional groups respectively and the functional groups could connect with the silver nanowires and restrain the silver nanowires from drifting. Because the functional groups of the dispersant monomers connect with the silver nanowires and copolymerize with the resin, the silver nanowires could disperse in the colloidal polymer formed by the copolymerization of acrylic acid and the resin. Practically, the dispersant (e.g. acrylic acid) could be substituted by other monomers capable of copolymerizing with the resin, but not limited to the embodiment. On the other hand, the resin could be, but not limited to, a polymer consisting of alphatic urethane acrylate and 2(2-Ethoxy ethoxy)ethyl acrylate ester.

Meanwhile, because the dispersant monomers in the embodiment (e.g. acrylic acid) restrain the silver nanowires from drifting, the silver drifting in the film switch manufactured by the compound of silver nanowire with polymer of the invention could be effectively restrained. In other words, compared to the film switch manufactured by the conductive silver colloid without dispersant (e.g. acrylic acid) in the prior art, the film switch manufactured by the compound of silver nanowire with polymer of the invention could have a longer lifetime instead of being easily damaged by the silver drifting.

Figure 1:
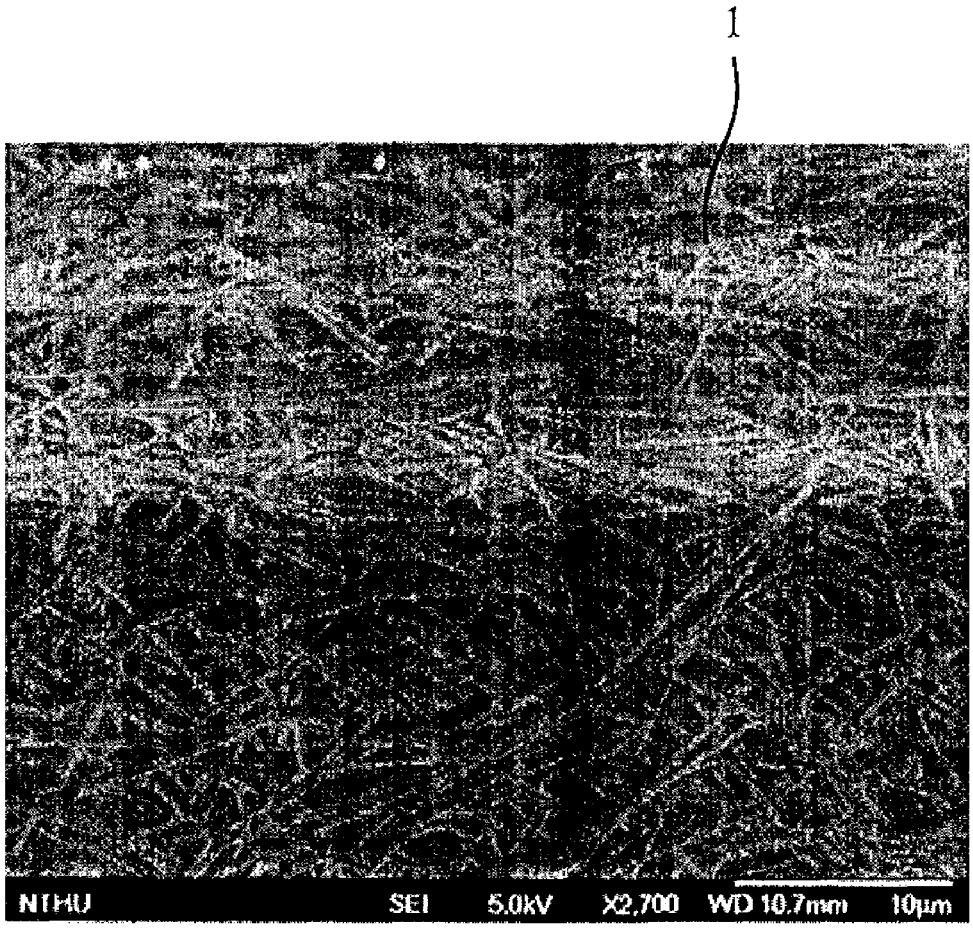
FIG. 1 is an SEM image showing the compound of silver nanowire with polymer according to an embodiment of the invention.

Please refer to FIG. 1. FIG. 1 is an SEM image showing the compound of silver nanowire with polymer according to an embodiment of the invention. In the embodiment, the content of silver nanowires is 67 wt %. As illustrated in FIG. 1, the long-bar structure is silver nanowires 1, which are well dispersed instead of gathering as a dendritic structure or a blocky structure. Practically, the compound of silver nanowire with polymer could be detected by Thermal Analyzer, however, even the temperature is risen to 1000° C., there is still little resin carburized to carbon fiber and survives thereon.

Practically, the content of silver nanowires in the compound affects the conductivity of the compound. Please refer to table 1. Table 1 lists the content of silver nanowires and the conductivity of the compound of silver nanowire with polymer in six embodiments. Please notice that the conductivity in Table 1 is represented by resistivity. Namely, the lower the resistivity of the compound is, the higher conductivity of the compound is. Furthermore, the resistivity of the compound film is obtained by the average resistance times the thickness of the film.

TABLE 1

The content of silver nanowires and the conductivity of the compound film.

| | No. | | | | | |
|---|---|---|---|---|---|---|
| | A | B | C | D | E | F |
| Ag content % | 69 | 67 | 63 | 60 | 50 | 49 |
| av. resistance mΩ | 6.96 | 63.61 | 3.82 | 9.26 | 20.51 | 32.96 |
| thickness μm | 21.9 | 48 | 48.5 | 77.63 | 52.22 | 88.8 |
| Ω · m | 1.52E−7 | 1.73E−7 | 1.85E−7 | 7.19E−7 | 1.07E−6 | 2.93E−6 |

It could be seen from Table 1 that the resistivity of the compound decreases with the increase of the silver content in the compound, that is to say, the conductivity increases. In the embodiment E, when the thickness of the film is 100 μm, the resistivity is about 2E-6 Ωm. Compared to a silver bulk with the same thickness (100 μm) which the resistivity is 1.5E-8 Ωm, the resistivity of the embodiment E is significantly higher, however, compared to the resistivity of compound films doped with the same content of silver nanoparticles (50 wt %) and with the same thickness (100 μm) which the resistivity is 1E-5 Ωm, the resistivity of the embodiment E is significantly lower.

On the other hand, in the prior art, if a conductive silver colloid doped with silver nanoparticles with the same thickness (100 μm) want to reach the same conductivity of the embodiment E, the content of silver nanoparticles should be over 90 wt %. Therefore, if taking a look at those with the same conductivity, the required content of silver nanowires would be much lower than that of silver nanoparticles. Practically, the result could lower the usage of silver material so as to reduce the cost.

As mentioned above, the polymer compound doped with silver nanowire has a better conductivity than the conductive silver colloid doped with silver nanoparticles. Because the length of a silver nanowire is longer than that of a nanoparticle, the compound of silver nanowire with polymer of the invention has a longer lower-resistance conducting path length (silver nano-material) and shorter higher-resistance conducting path length (resin) than the conductive silver colloid doped with silver nanoparticles, so that it has a better conductivity.

Figure 2:
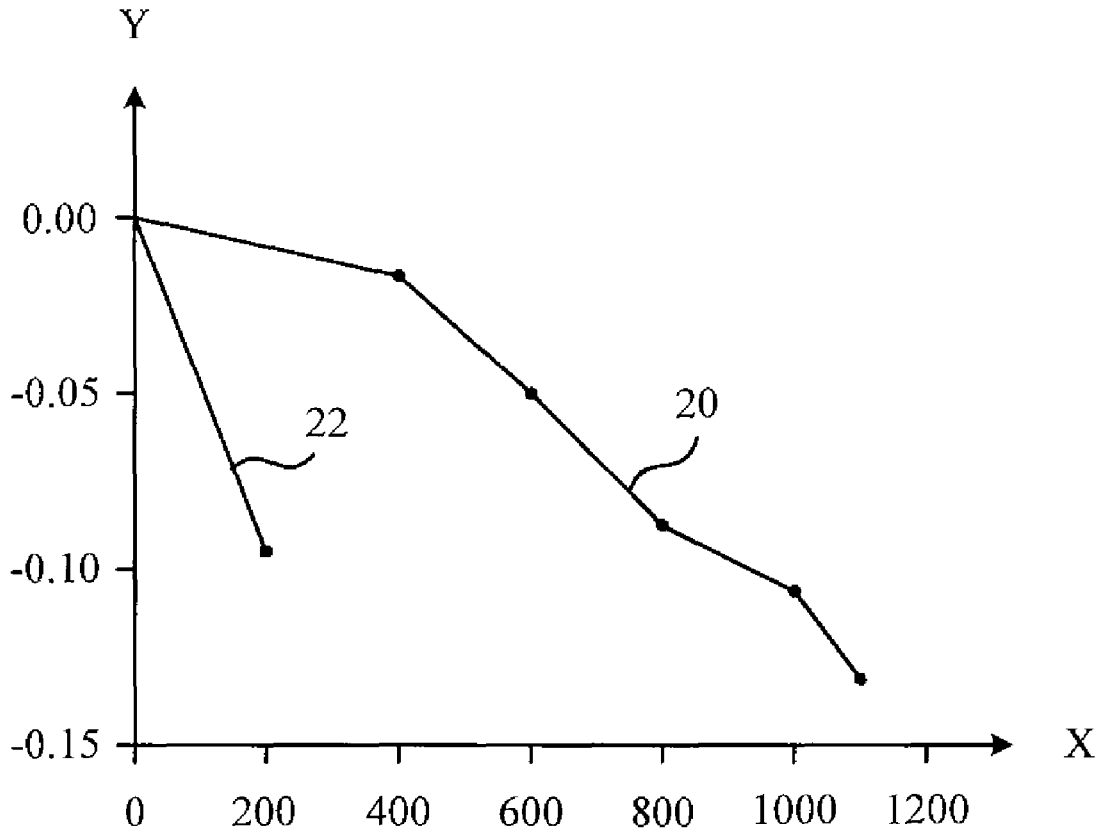
FIG. 2 illustrates the wearability of the compound of silver nanowire with polymer according to another embodiment of the invention.

Please refer to FIG. 2. FIG. 2 illustrates the wearability of the compound of silver nanowire with polymer according to another embodiment of the invention. The line segment 20 represents the compound doped with silver nanowires, and the line segment 22 represents the conductive silver colloid doped with silver nano-particles (the diameter is 35 nm). The silver content of both are 49 wt %. In the embodiment, the conductivity of both is measured by Taber test. The X axis in FIG. 2 is the revolving circles of the friction wheel, and the Y axis is the losing weight (gram) of the compound. As illustrated in FIG. 2, after the friction wheel revolving for 200 circles, the losing weight of the line segment 20 smaller that that of the line segment 22. On the other hand, the losing weight of the line segment 20 after the friction wheel revolving for 900 circles is substantially equal to that of the line segment 22 after revolving for 200 circles. As mentioned above, compared to the conductive silver colloid doped with silver nanoparticles, the compound of silver nanowire with polymer of the invention has a better wearability.

However, the polymer compound doped with silver nanowires not only has advantages of a better conductivity and wearability than the conductive silver colloid doped with silver nanoparticles, but also the chelating functional groups of dispersant could restrain silver from drifting, and this could be further suitable for silver nanoparticles or other nano-types of silver material. Moreover, it could be suitable for other polymer compounds doped with various nano-type metals.

According to another embodiment, the compound of metal nanostructure with polymer of the invention comprises a colloid, a copolymer and metal nanostructures. The copolymer copolymerizes with the colloid to form a colloidal polymer. Each of the monomer of the copolymer has a chelating functional group respectively, and the chelating functional groups could connect with the metal nanostructures and restrain the metal nanostructures from drifting. Practically, the chelating functional group could include at least one selected from a group consisting of carboxylic (—COOH), phosphate (—$POxy^{-x,y}$, wherein x and y are integers between 1 and 4), hydrosulfide (—SH, —S—) and sulphate (—$SO_3^-$). Because the monomers of the copolymer connect with the metal nanostructures and copolymerize with the colloid, the metal nanostructures could disperse in the colloidal polymer formed by the copolymerization of copolymer and the colloid. Practically, the colloid could be, but not limited to, resin. Particularly, the colloid could be a polymer consisting of alphatic urethane acrylate and 2(2-Ethoxy ethoxy)ethyl acrylate ester. Furthermore, the dispersant copolymer could be, but not limited to, acrylic acid in practical applications. Similarly, the metal nanostructure could be, but not limited to, a silver nanowire in practical applications.

The compound of silver nanowire with polymer mentioned above could be manufactured by the following method. Firstly, the silver nanowires are attracted by the monomers of the dispersant (e.g. acrylic acid). Because the monomers of the dispersant have acid radicals which are capable of connecting silver nanowires, the silver nanowires could disperse in the dispersant (e.g. acrylic acid). Subsequently, the polymer (called resin for short in the followings) formed of alphatic urethane acrylate and 2(2-Ethoxy ethoxy)ethyl acrylate ester together with the dispersant (e.g. acrylic acid) which connects the silver nanowires are dissolved and well dispersed in a solvent to form a first solution. Please notice that the solvent could be, but not limited to, acetonitrile, however, it could depend on practical situations.

Both of the resin and the monomers of the acrylic acid have C═C double bonds capable of co-polymerization, so that when adding free radical initiator to the first solution and heating it to a specific temperature, the resin and the monomers of the dispersant (e.g. acrylic acid) could copolymerize so as to form the compound mentioned above. Practically, the free radical initiator mentioned above could be, but not limited to, Benzoyl Peroxide. Moreover, the temperature of the copolymerization of the resin and the acrylic acid could be, but not limited to, 120° C. Practically, the heating method could be substituted by illuminating to help process the copolymerization.

Figure 3:
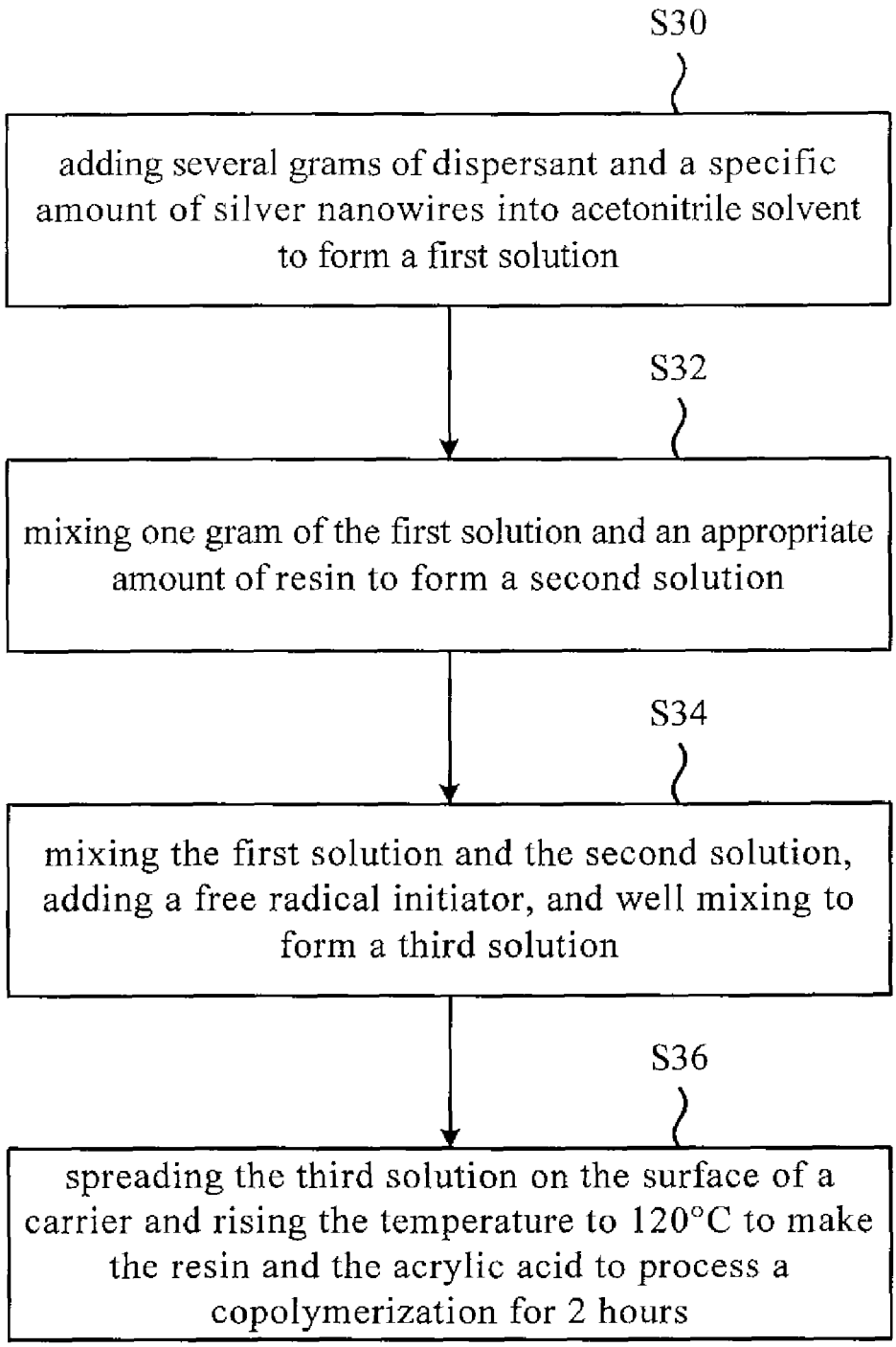
FIG. 3 is a flow chart demonstrating a method of manufacturing the compound of silver nanowire with polymer according to an embodiment of the invention.

Please refer to FIG. 3. FIG. 3 is a flow chart demonstrating a method of manufacturing the compound of silver nanowire with polymer according to an embodiment of the invention. As illustrated in FIG. 3, the detail method for manufacturing the compound mentioned above is as the followings. In step S30, several grams of dispersant (e.g. acrylic acid) and a specific amount (depending on practical requirement) of silver nanowires are added into acetonitrile solvent to form a first solution. In step S32, one gram of the first solution and an appropriate amount of resin are mixed to form a second solution. In step S34, the first solution and the second solution are mixed, then a free radical initiator is added therein and well mixed to form a third solution. In step S36, the third solution is spread on the surface of a carrier and the temperature is risen to 120° C. to make the resin and the acrylic acid to process a copolymerization for 2 hours. The compound of nanowires with polymer could be obtained by means of the steps mentioned above.

The compound of nanowires with polymer and the compound of metal nanostructures with polymer mentioned above could be applied to painting, coating, fiber, conductive printing ink, electromagnetic shielding or bacteriostasis, etc, owing to its good conductivity and wearability, but not limited to the application of the conductive colloid in the specification.

Compared to the prior art, the compound of silver nanowire with polymer is formed by doping the silver nanowires into the resin. Compared to the conductive colloid doped with silver nanoparticles, the conductive colloid doped with silver nanowires has a better conductivity and wearability, so that the cost could be reduced. The compound of the invention further includes the dispersant with chelating functional groups (e.g. acid radical). The chelating functional groups are capable of connecting the silver nanowires and meanwhile the monomers of the dispersant could copolymerize with the resin. By means of the chelating functional groups, the nanowires could be well dispersed in the compound. The chelating functional groups attract the silver nanowires strongly to restrain the silver from drifting, so as to improve the yield of the film switch formed by the compound of silver nanowire with polymer of the invention. Particularly, the film switch formed by the compound of the invention doesn't require extra carbon layer so as to avoid the effect caused by the peeling off carbon layer. Moreover, the method of dispersing silver nanowires in a compound of the invention could be suitable for other nano-types of silver or other metals. On the other hand, the compound of metal nanostructure with polymer could be applied to other fields such as electromagnetic shielding, radar beam absorbing, bacteriostatic coating, printing ink or painting, etc, but not limited to the conductive colloid.

Although the present invention has been illustrated and described with reference to the preferred embodiment thereof, it should be understood that it is in no way limited to the details of such embodiment but is capable of numerous modifications within the scope of the appended claims.

What is claimed is:

1. A compound of a thickness T (in μm), a resistivity R (in Ohm·m), a product of an average resistance Ra of the compound and T, and a content C (in wt %) of silver nanowire with polymer, comprising:

a resin;

a dispersant copolymerizing with the resin, the dispersant comprising a plurality of dispersant monomers, and each of the plurality of dispersant monomers including one or more chelating functional group; and a plurality of silver nanowires; connecting, in chemical bond to the plurality of chelating functional groups, respectively, and dispersing in the resin, wherein i) the plurality of silver nanowires are evenly distributed without clotting together in dendrites or blocks in SEM image of the compound when the content C of silver nanowire is 67; and ii) C and R are in a negative linear relationship (anticorrelation), given C ranging from 49 to 69 in an increasing order, and given T ranging from 88.8 to 21.9 in a decreasing order.

2. The compound of claim 1, wherein the resin comprises a polymer which consists of aliphatic urethane acrylate and 2(2-Ethoxy ethoxy) ethyl acrylate ester.

3. The compound of claim 1, wherein the dispersant comprises acrylic acid.

4. The compound of claim 1, wherein the chelating functional group comprises at least one selected from a group consisting of carboxylic, phosphate, hydrosulfide and sulphate.

5. The compound of claim 1 further comprising a solvent for dissolving the resin, the dispersant, and the plurality of silver nanowires.

6. The compound of claim 5, wherein the solvent is acetonitrile.

7. The compound of claim 1, wherein the resin and the acrylic acid process a copolymerization by means of the assistance of a free radical initiator under a condition of a heating temperature or being illuminated.

8. The compound of claim 7, wherein the heating temperature is 120° C.

9. The compound of claim 7, wherein the free radical initiator is benzoyl peroxide.

10. A compound of a thickness T (in μm), a resistivity R (in Ohm·m), a product of an average resistance Ra of the compound and T, and a content C (in wt %) of metal nano structure with polymer, comprising:

a colloid;

a copolymer copolymerizing with the colloid, the copolymer comprising a plurality of copolymer monomers, and each of the plurality of copolymer monomers including an acid radical; and a plurality of metal nanostructures connecting in chemical bond to the plurality of acid radicals, respectively, and dispersing in the colloid, wherein i) the plurality of metal nanostructure are evenly distributed without clotting together in dendrites or blocks in a SEM image of the compound when the content C of metal nanostructures is 67; and ii) C and R are in a negative linear relationship (anticorrelation).

11. The compound claim 10, wherein the colloid is a resin.

12. The compound of claim 11, wherein the resin comprises a polymer which consists of alphatic urethane acrylate and 2(2-Ethoxy ethoxy)ethyl acrylate ester.

13. The compound of claim 10, wherein the copolymer is an acrylic acid.

14. The compound of claim 10 further comprising a solvent for dissolving the colloid, the copolymer, and the plurality of metal nanostructures.

15. The compound of claim 14, wherein the solvent is acetonitrile.

16. The compound of claim 10, wherein the colloid and the copolymer process a copolymerization by means of the assistance of a free radical initiator under a condition of a heating temperature or being illuminate.

17. The compound of claim 16, wherein the heating temperature is 120° C.

18. The compound of claim 16, wherein the free radical initiator is benzoyl peroxide.

19. The compound of claim 10, wherein the metal nanostructure is a nano-sized of metal.

20. The compound of claim 19, wherein the nano-sized metal comprises at least one selected from a group consisting of silver nanoparticle and silver nanowire.

* * * * *